US006328463B1

(12) United States Patent
Okubo

(10) Patent No.: US 6,328,463 B1
(45) Date of Patent: Dec. 11, 2001

(54) AUTOMOBILE HEADLAMP

(75) Inventor: Yasuhiro Okubo, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 0 days.

(21) Appl. No.: 09/401,956

(22) Filed: Sep. 23, 1999

(30) Foreign Application Priority Data

Sep. 25, 1998 (JP) ..... 10-272050

(51) Int. Cl.[7] ..... F21V 7/00
(52) U.S. Cl. ..... 362/518; 362/211; 362/543
(58) Field of Search ..... 362/487, 543, 362/519, 518, 211, 215

(56) References Cited

U.S. PATENT DOCUMENTS 4,945,453 * 7/1990 Serizawa et al. ..... 362/211 X
5,215,368 * 6/1993 Neumann ..... 362/211 X
5,725,298 * 3/1998 Kalze et al. ..... 362/214

FOREIGN PATENT DOCUMENTS 8-329703 * 12/1996 (JP) .
9-237504 * 9/1997 (JP) .
9-306220 * 11/1997 (JP) .

* cited by examiner

*Primary Examiner*—Stephen Husar
(74) *Attorney, Agent, or Firm*—Foley & Lardner

(57) ABSTRACT

The low beam filament and the high beam filament are disposed in such a positional relationship as the virtual image of the irradiated portion of the high beam filament does not produce glaring light in the low beam light distribution pattern. As a result, it is made possible to effectively utilize near 100% of light incident on the reflecting surface of a reflector and to obtain good low beam light distribution pattern and high beam light distribution pattern.

5 Claims, 20 Drawing Sheets

1lx = 625cd

AUTOMOBILE HEADLAMP

BACKGROUND OF THE INVENTION

1. Field of the Invention

The present invention relates to an automobile headlamp such as dual-lamp halogen headlamp, that provides a predetermined low beam light distribution pattern and a high beam light distribution pattern by means of control of all-surface reflection light distribution of the reflecting surface, and particularly to an automobile headlamp that makes it possible to utilize near 100% of light incident on the reflecting surface of a reflector and to obtain good low beam light distribution pattern and high beam light distribution pattern.

The word "ahead" used in this specification refers to the direction in which the automobile moves, that is the forward direction in view of the driver. Letter "L" used in the accompanying drawings indicates the left-hand side in view of the driver looking ahead, and letter "R" used in the accompanying drawings indicates the right-hand side in view of the driver looking ahead. Letter "U" used in the accompanying drawings indicates the upper side in view of the driver looking ahead, and letter "D" used in the accompanying drawings indicates the lower-hand side in view of the driver looking ahead. Letters "HL-HR" used in the accompanying drawings indicate a horizontal line (or a horizontal axis) viewed by the driver looking ahead, and letters "HR-HL" used in the accompanying drawing indicate a horizontal line (or a horizontal axis) when viewing the automobile (or the surface that includes headlamps) from the front side (the so-called front view or plan view), and letters "VU-VD" indicate the vertical line (or a vertical axis).

2. Description of the Prior Art

Automobile headlamps of this type, namely automobile headlamps that make it possible to obtain a predetermined low beam light distribution pattern and high beam light distribution pattern by means of control of all-surface reflection light distribution of the reflecting surface include, for example, one that is disclosed in Japanese Unexamined Patent Publication No. Hei 8-329703.

This automobile headlamp will be described below with reference to FIG. 15 through FIG. 24. Further, the automobile headlamp shown in the drawings is to be mounted on the left side (left-hand side in view of the driver facing ahead) of an automobile in keep-right traffic. In the case of an automobile headlamp mounted on an automobile in keep-left traffic, the automobile headlamp, a reflecting surface 40, a high beam filament 52 and other devices are disposed in a reverse arrangement to that shown with regard to right and left. Further, the automobile headlamp to be mounted on the right side of the automobile has a lamp housing 1, a lens 2 and a reflector 4 of substantially symmetrical configuration as those of the automobile headlamp shown, without any change in the arrangement of the reflecting surface 40, the high beam filament 52 and other devices.

The automobile headlamp has a light room 3 formed by the lamp housing 1 and the lens (outer lens) 2. Disposed in the light room 3 is a reflector 4, which is separate from the lamp housing 1, to be capable of swinging in the vertical and horizontal directions by means of a pivot mechanism (not shown) and an optical axis adjusting device (not shown). The reflector 4 has the reflecting surface 40 formed from a complex reflecting surface. The reflecting surface 40, namely the complex reflecting surface, comprises a plurality of reflecting surface segments (not shown) divided vertically and horizontally, and is called the free curved surface. The free curved surface may be, as described in Japanese Unexamined Patent Publication No. Hei 9-306220, for example, one divided into a multitude of blocks, one divided into a small number of blocks, or one comprising a plurality of blocks continuously connected (joints between the blocks not being visible).

Although the complex reflecting surface does not have a single focal point in the exact sense of the word, there are only negligible differences between the focal lengths of the plurality of revolving paraboloid surfaces that form the complex reflecting surface. Thus because the plurality of revolving paraboloid surfaces share substantially the same focus, the focal point F shown in the drawing that is a pseudo-focus in the true meaning will be called the focal point in this specification. Similarly, the optical axis Z—Z shown in the drawing that is a pseudo-optical axis in the true meaning will be called the optical axis in this specification.

The reflector 4 described above has a light source bulb 5 mounted thereon detachably. The light source bulb 5 is a light source bulb without a shading hood, and has a low beam (beam for passing oncoming vehicle) filament 51 and a high beam (beam for running without oncoming vehicle) filament 52 disposed in the glass bulb 50. Also the glass bulb 50 has a coating 54 (for blocking the light from the low beam filament 51 and from the high beam filament 52 from directly entering the lens 2) of black paint, for example, provided at the tip thereof.

The low beam filament 51 described above has a substantially cylindrical shape, disposed substantially in parallel with the optical axis Z—Z at a position ahead of the focal point F. The high beam filament 52 also has a substantially cylindrical shape, disposed substantially in parallel with the optical axis Z—Z at a position near the focal point F and obliquely below the low beam filament (lower right-hand side in the case of keep-right traffic, lower left-hand side in the case of keep-left traffic), or right below thereof.

In the drawings, reference numeral 6 denotes a shade. The shade 6 is secured onto the reflector 4 and covers the light source bulb 5 at the front thereof, for the purpose of blocking the light from the low beam filament 51 and from the high beam filament 52 from directly entering an ineffective portion (a portion that does not directly contribute to the light distribution of the headlamp) 42 of the reflector 4 and the lens 2. Reference numeral 60 denotes a rubber cap. The rubber cap 60 is fitted detachably between a base of the light source bulb 5 and a rear opening of the lamp housing 1 by means of a fitting cap 61, thereby to keep the inside of the light room 3 water-tight.

When the low beam filament 51 of the automobile headlamp described above is turned on, light from the low beam filament 51 is reflected on the entire surface of the reflecting surface 40, and the reflected light is radiated through the lens 2 to the outside in a predetermined low beam light distribution pattern LP as shown in FIG. 18. On the other hand, when the high beam filament 52 is turned on, light from the high beam filament 52 is reflected on the entire surface of the reflecting surface 40, and the reflected light is radiated through the lens 2 to the outside in a predetermined high beam light distribution pattern HP as shown in FIG. 19.

In this way, the predetermined low beam light distribution pattern LP and the predetermined high beam light distribution pattern HP are formed by the control of all-surface reflection light distribution of the reflecting surface 40.

The predetermined low beam light distribution pattern LP and the predetermined high beam light distribution pattern HP described above refer to light distribution patterns in conformity with the European Light Distribution Standard ECEReg. or an equivalent regulation (for example, model recognition standard for vehicles sold in Japan), North American Light Distribution Standard FMVSS, etc.

The low beam light distribution pattern LP described above is made to comply with light distribution standard so that dazzling light is restricted. As a result, the low beam light distribution pattern LP described above has such a beam boundary 71 that does not annoy the driver of an oncoming vehicle 7 and a pedestrian 70 on the right road edge as shown in FIG. 18. The beam boundary 71 consists of a horizontal line portion 72 extending from the left end to near the center and located a little below the horizontal line HL-HR determined to avoid dazzling the driver of the oncoming vehicle 7, a mildly sloped line portion 73 that goes up from the horizontal line portion 72 at substantially the center toward the right at a small angle, 15° for example, to make it possible to recognize the pedestrian 70 on the right road edge without dazzling the pedestrian 70 on the right road edge, and a sloped line portion 74 that goes down from the mildly sloped line portion 73 rightward to join the horizontal line portion 72. There is no standard related to the maximum luminous intensity in the low beam light distribution pattern LP.

For the high beam light distribution pattern HP described above, on the other hand, there are light distribution standards specified for the maximum luminous intensity and maximum luminous intensity zone, etc. As a result, the high beam light distribution pattern HP described above has a hot zone HZ (maximum luminous intensity zone including a point of maximum luminous intensity) in the central portion as shown in FIG. 19. The values of maximum luminous intensity specified in the European Light Distribution Standard ECEReg. is from 48 to 240 lx (1 lx=625 cd measured on a screen at a distance of 25 m), while the luminous intensity at an intersect H-V of the horizontal line HL-HR and the vertical line VU-VD is 80% of the maximum luminous intensity or higher (model recognition).

For the automobile headlamp described above, it is important to be capable of achieving good low beam light distribution pattern LP and high beam light distribution pattern HP.

In the automobile headlamp described above, the low beam filament 51 and the high beam filament 52 are disposed close to each other as shown in FIG. 20 and FIG. 21. Consequently, when the low beam filament 51 is turned on, a part L of the light from the low beam filament 51 illuminates a part of the high beam filament 52, namely an irradiated portion 520, and is reflected thereon. Reflection on the irradiated portion 520 of the high beam filament 52 has such an effect as if the irradiated portion 520 of the high beam filament 52 is lit with a low voltage simultaneously with the low beam filament 51. The irradiated portion 520 of the high beam filament 52 appears as a virtual image 86 in the low beam light distribution pattern LP as indicated by the shaded portion in FIG. 23, due to the maximum luminous intensity zone forming portion 85 (portion indicated by the solid line in FIG. 22) of the reflecting surface 40. The irradiated portion 520 of the high beam filament 52 described above does not make the virtual image 86 in portions other than the maximum luminous intensity zone forming portion 85 of the reflecting surface 40, since the light is diffused therein.

In FIG. 22, first quadrant 81, second quadrant 82, third quadrant 83 and fourth quadrant 84 are quadrants of the reflector 4 in front view. The maximum luminous intensity zone forming portion 85 tends to form a fan shape located below the horizontal line HR-HL, in many cases. At points A and B of the maximum luminous intensity zone forming portion 85, a light distribution pattern as shown in FIG. 23 is obtained. That is, light distribution patterns 87A, 87B indicated by solid lines are obtained with the low beam, and light distribution patterns 88A, 88B indicated by broken lines are obtained with the high beam. Since the automobile headlamp forms the predetermined low beam light distribution pattern LP and the predetermined high beam light distribution pattern HP by means of the control of all-surface reflection light distribution of the reflecting surface 40, the light distribution patterns 87A, 87B and the light distribution patterns 88A, 88B obtained at the points A and B of the maximum luminous intensity zone forming portion 85 have the same or similar shapes and are adjacent to each other as shown in FIG. 23, while the light distribution patterns 88A, 88B of the high beam are located above the light distribution patterns 87A, 87B of the low beam.

As a consequence, when the low beam filament 51 is turned on, the virtual image 86 of the irradiated portion 520 of the high beam filament 52 appears above the beam boundary lines 71, 72 and 73 of the low beam light distribution pattern LP as indicated by the shaded portion in FIG. 23. The virtual image 86 may appear as virtual image glare (glaring light) VIG (verified with 0.4 and 0.7 [lx] lines) at a point (or zone) GP of the European Light Distribution Standard ECEReg. where glaring light is strictly limited as shown in FIG. 24, due to the positional relationship between the low beam filament 51 and the high beam filament 52.

FIG. 24 shows isocandela diagrams measured on a screen located at a distance of 25 m. The isocandela diagrams are lines of 0.4, 0.7, 1.6, 4, 10, 16 and 25 [lx] (1 lx=625 cd), from the outermost one inward. In the isocandela diagrams of FIG. 24, 5L represents 5° on the left and 5R represents 5° on the right.

An application for an invention of automobile headlamp to eliminate the virtual image glare VIG described above (disclosed in Japanese Unexamined Patent Publication No. Hei 9-237504) was previously filed. The automobile headlamp (disclosed in Japanese Unexamined Patent Publication No. Hei 9-237504) has a low beam filament and a high beam filament separated by a shading hood such as an H4 valve to eliminate the virtual image glare VIG described above.

However, the automobile headlamp (disclosed in Japanese Unexamined Patent Publication No. Hei 9-237504) is not capable of effectively utilize near 100% of the light incident on the reflecting surface of the reflector because about 30 to 40% of the light incident on the reflecting surface of the reflector is cut off.

SUMMARY OF THE INVENTION

An object of the present invention is to provide an automobile headlamp capable of utilizing near 100% of the light incident on the reflecting surface of the reflector and producing good low beam light distribution pattern and high beam light distribution pattern.

The present invention, in order to achieve the object described above, is characterized in that the low beam filament and the high beam filament are disposed in such positional relationships as the virtual image of an irradiated portion of the high beam filament does not become glaring light in the low beam light distribution pattern.

As a result, the automobile headlamp according to the present invention is capable of utilizing near 100% of the light incident on the reflecting surface of the reflector and producing good low beam light distribution pattern and high beam light distribution pattern.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
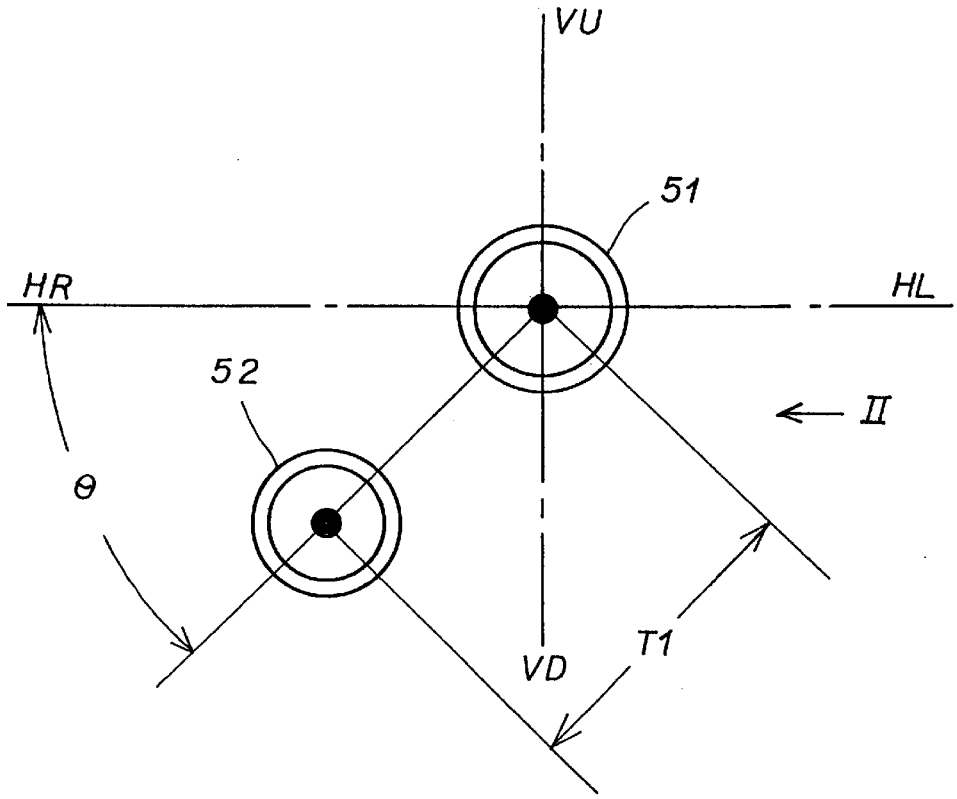
FIG. 1 is a front view of an embodiment of an automobile headlamp according to the invention, explanatory of the positional relationship between low beam filament and high beam filament.

Now an embodiment of the automobile headlamp according to the present invention will be described below with reference to FIG. 1 through FIG. 14. In the drawings, reference numerals identical with those in FIG. 15 through FIG. 24 denote the same components. The automobile headlamp shown in these drawings is to be mounted on the left side of an automobile in keep-right traffic, similarly to the automobile headlamp shown in FIG. 15 through FIG. 24.

Figure 2:
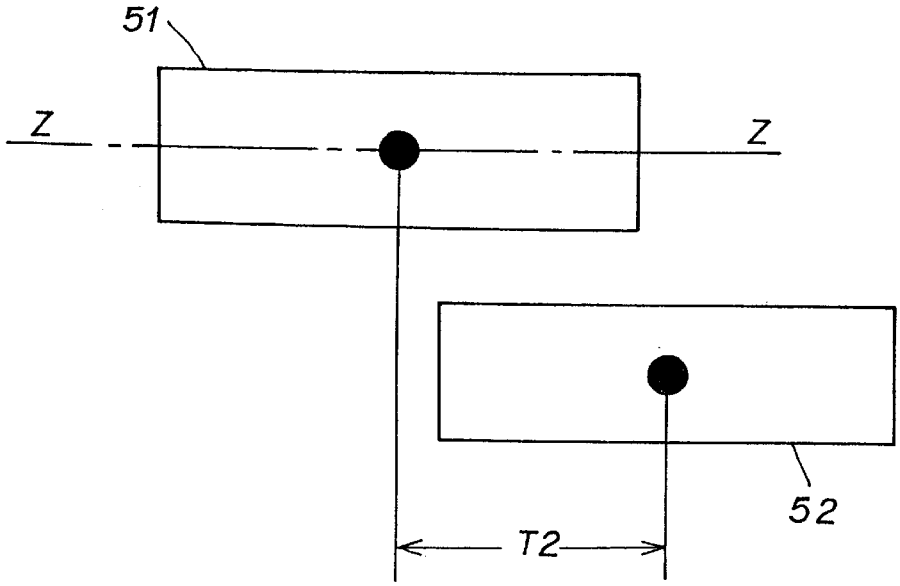
FIG. 2 is a view along line II in FIG. 1.

In the automobile headlamp of the present invention according to this embodiment, the low beam filament 51 and the high beam filament 52 are disposed in such positional relationships as shown in FIG. 1 and FIG. 2, namely the angle θ between the line connecting the center of the low beam filament 51 and the center of the high beam filament 52 in the front view projection and the horizontal line HL-HR; the distance T1 between the center of the low beam filament 51 and the center of the high beam filament 52 in front view projection; and the distance T2 between the center of the low beam filament 51 and the center of the high beam filament 52 in the longitudinal direction in side view projection, so that the virtual image 86 of the irradiated portion 520 of the high beam filament 52 does not become glaring light in the low beam light distribution pattern LP.

Now the conditions of the positional relationships θ, T1 and T2 between the low beam filament 51 and the high beam filament 52 described above will be described below.

Figure 3:
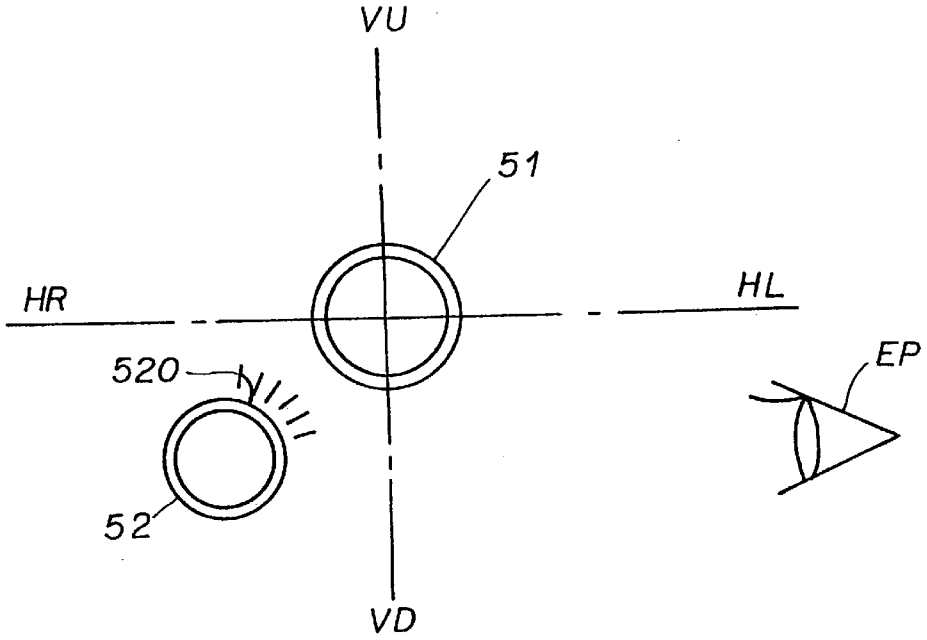
FIG. 3 is a front view for the explanation of a state where the irradiated portion is visible as a whole.
Figure 5:
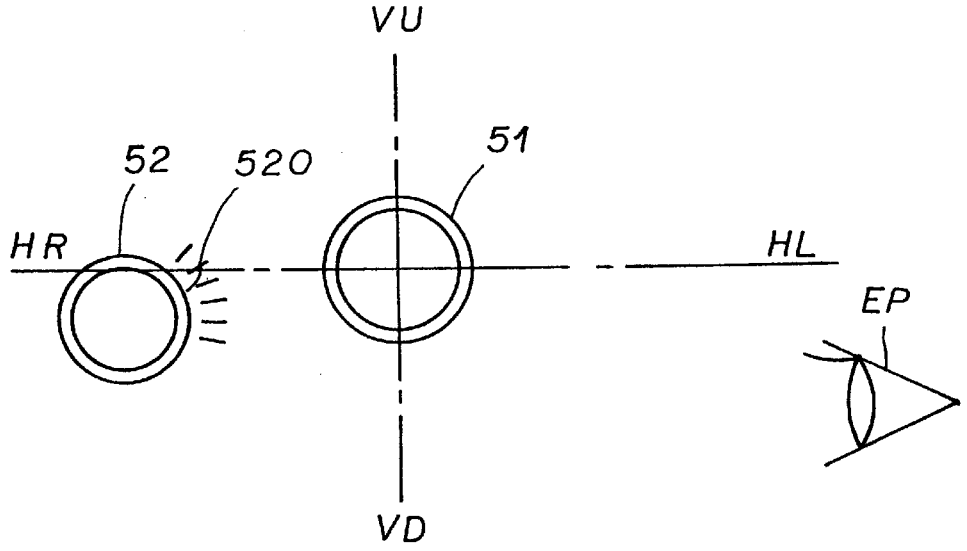
FIG. 5 is a front view for the explanation of a state where the irradiated portion is almost invisible.
Figure 7:
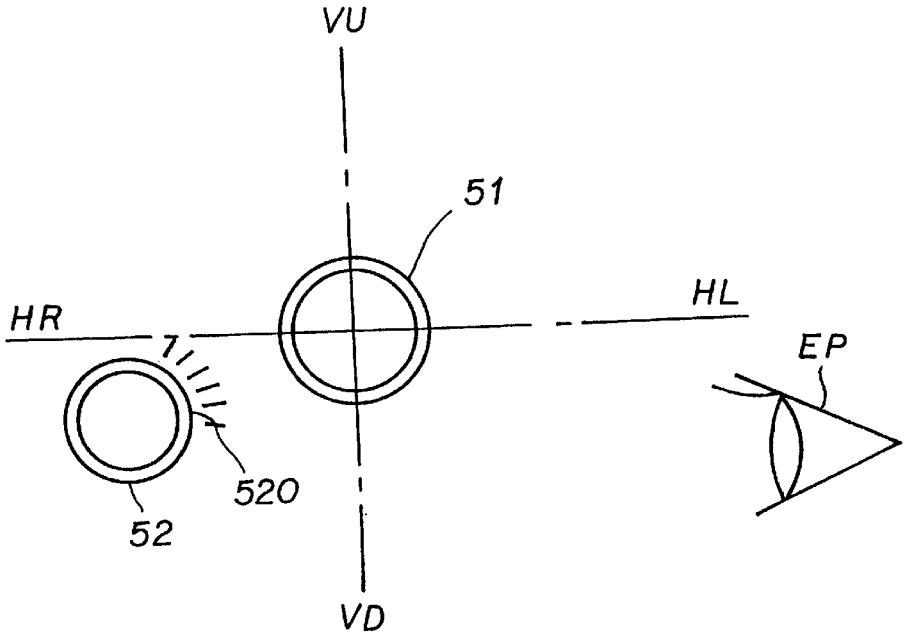
FIG. 7 is a front view for the explanation of a state where the irradiated portion is partially visible.

Suppose that the low beam filament 51 and the high beam filament 52 are viewed from an arbitrary eye point EP of the maximum luminous intensity zone forming portion 85 of the reflecting surface 40 while changing the value of θ, as shown in FIG. 3, FIG. 5 and FIG. 7.

Figure 4:
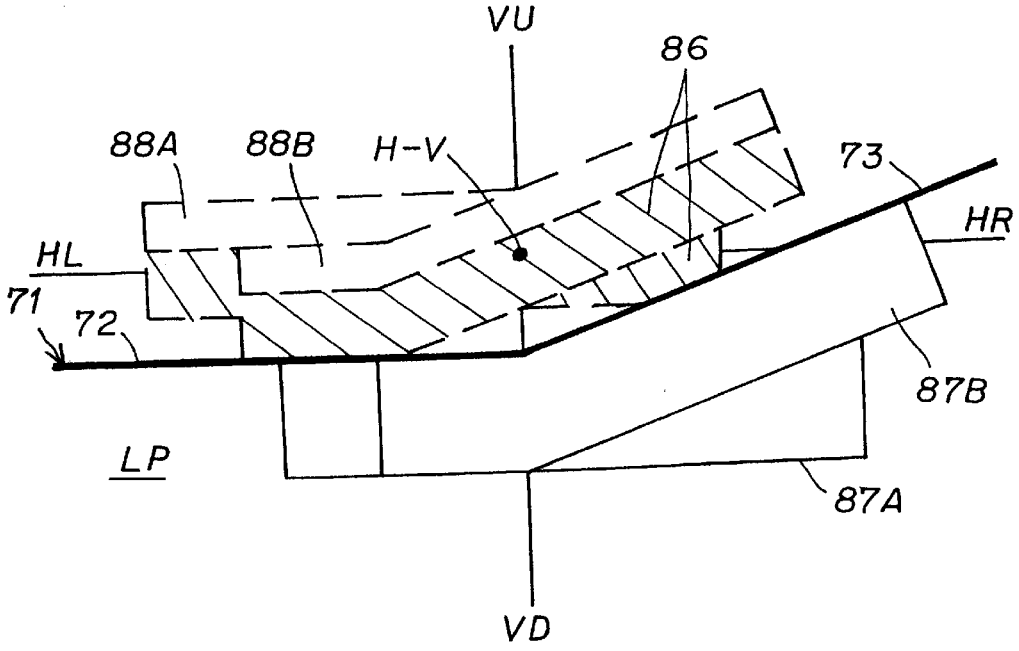
FIG. 4 is a screen image diagram for the explanation of a state where the virtual image glare light appears in the case of FIG. 3.

First, in case where the irradiated portion 520 of the high beam filament 52 is located below the lower end of the low beam filament 51 as shown in FIG. 3, the irradiated portion 520 is visible as a whole. That is, the irradiated portion 520 as a whole is reflected in the maximum luminous intensity zone forming portion 85 of the reflecting surface 40, and consequently a virtual image (shaded portion) 86 appears as virtual image glare near an intersect H-V (zone III) of the horizontal line HL-HR and the vertical line VU-VD among the light distribution standard glaring light limiting points (zones) located above the beam boundary lines 71, 72, and 73, as shown in FIG. 4.

Figure 6:
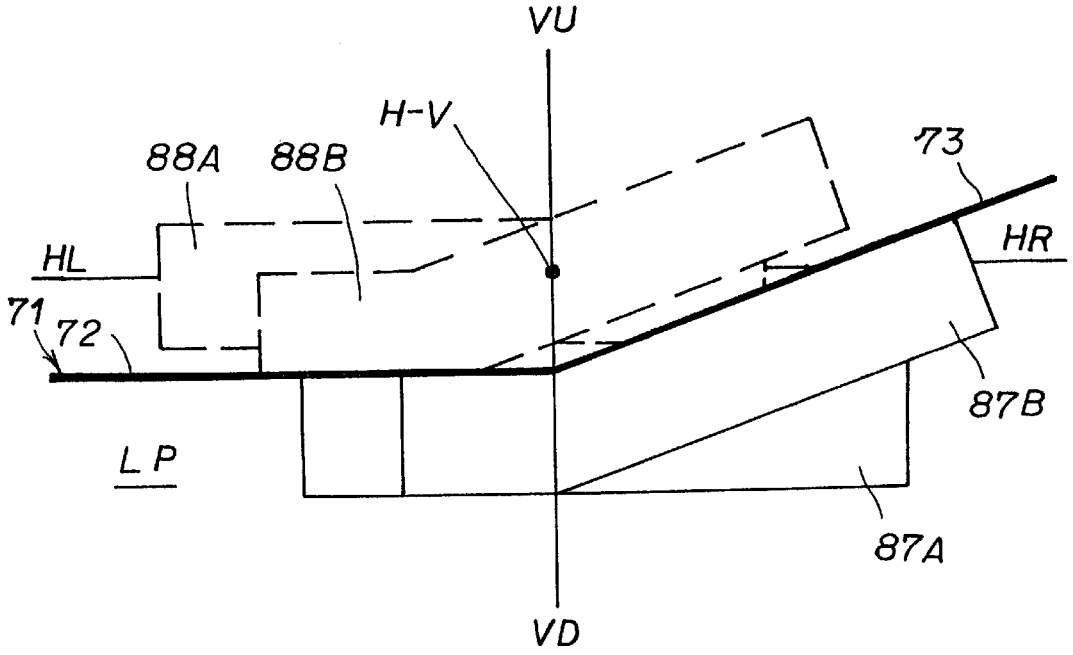
FIG. 6 is a screen image diagram for the explanation of a state where the virtual image glare light does not appear in the case of FIG. 5.

In case where the irradiated portion 520 of the high beam filament 52 is located above the lower end of the low beam filament 51 as shown in FIG. 5, the irradiated portion 520 is almost invisible. Thus since most of the irradiated portion 520 is not reflected in the maximum luminous intensity zone forming portion 85 of the reflecting surface 40, the virtual image 86 does not appear as shown in FIG. 6.

Figure 8:
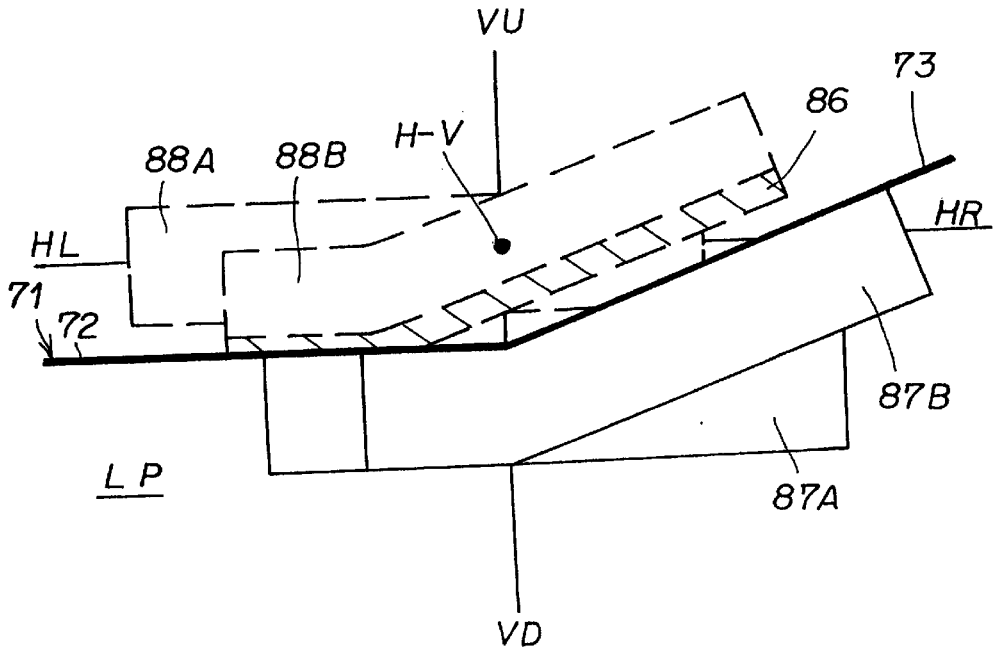
FIG. 8 is a screen image diagram for the explanation of a state where the virtual image appears but shifts downward from the light distribution standard glaring light limiting point in the case of FIG. 7.

In case where the irradiated portion 520 of the high beam filament 52 is located a little below the lower end of the low beam filament 51 as shown in FIG. 7, a part of the irradiated portion 520 is visible. That is, the part of the irradiated portion 520 is reflected in the maximum luminous intensity zone forming portion 85 of the reflecting surface 40, and consequently the virtual image 86 appears as shown in FIG. 8, although the virtual image 86 is located below the intersect H-V (zone III) of the horizontal line HL-HR and the vertical line VU-VD among the light distribution standard glaring light limiting points (zones) located above the beam boundary lines 71, 72, and 73 as shown in FIG. 8 and, in addition, has a light intensity lower than that shown in FIG. 4, so that virtual image glare does not appear.

In FIG. 3 through FIG. 8, displacements in the positions of the high beam light distribution patterns 88A, 88B due to a change in the value of θ are shown as corrected with T1 and T2, respectively, in order to have the high beam light distribution patterns 88A, 88B at almost the same positions for the convenience of description.

Therefore, when the value of θ is set to avoid the state shown in FIG. 3 and FIG. 4 and the values of T1 and T2 are set in consideration of the light distribution of high beam, good low beam light distribution pattern LP and high beam light distribution pattern HP without glaring light due to the virtual image 86 can be obtained. Furthermore, near 100% of light incident on the reflecting surface 40 of the reflector 4 can be effectively utilized.

Specifically, when the value of θ is set in a range from 10° to 30° and the values of T1 and T2 are set in ranges from 2.0 to 3.5 mm and from 1.5 to 4.0 mm, respectively, good low beam light distribution pattern LP and high beam light distribution pattern HP without glaring light due to the virtual image 86 can be obtained. Furthermore, near 100% of light incident on the reflecting surface 40 of the reflector 4 can be effectively utilized.

Conditions of the light source bulb 5 at this time are diameter of the glass bulb 50 being in a range from 14 to 18 mm, lengths of the filaments 51, 52 being in a range from 4.0 to 6.0 mm and diameters of the filaments 51, 52 being in a range from 1.2 to 1.6 mm. These conditions of the light source bulb 5 are determined properly and practically based on experience by taking into account the service life, light intensity, manufacturability, usability, capability to maintain the performance and other factors of the automobile headlamp.

Figure 25:
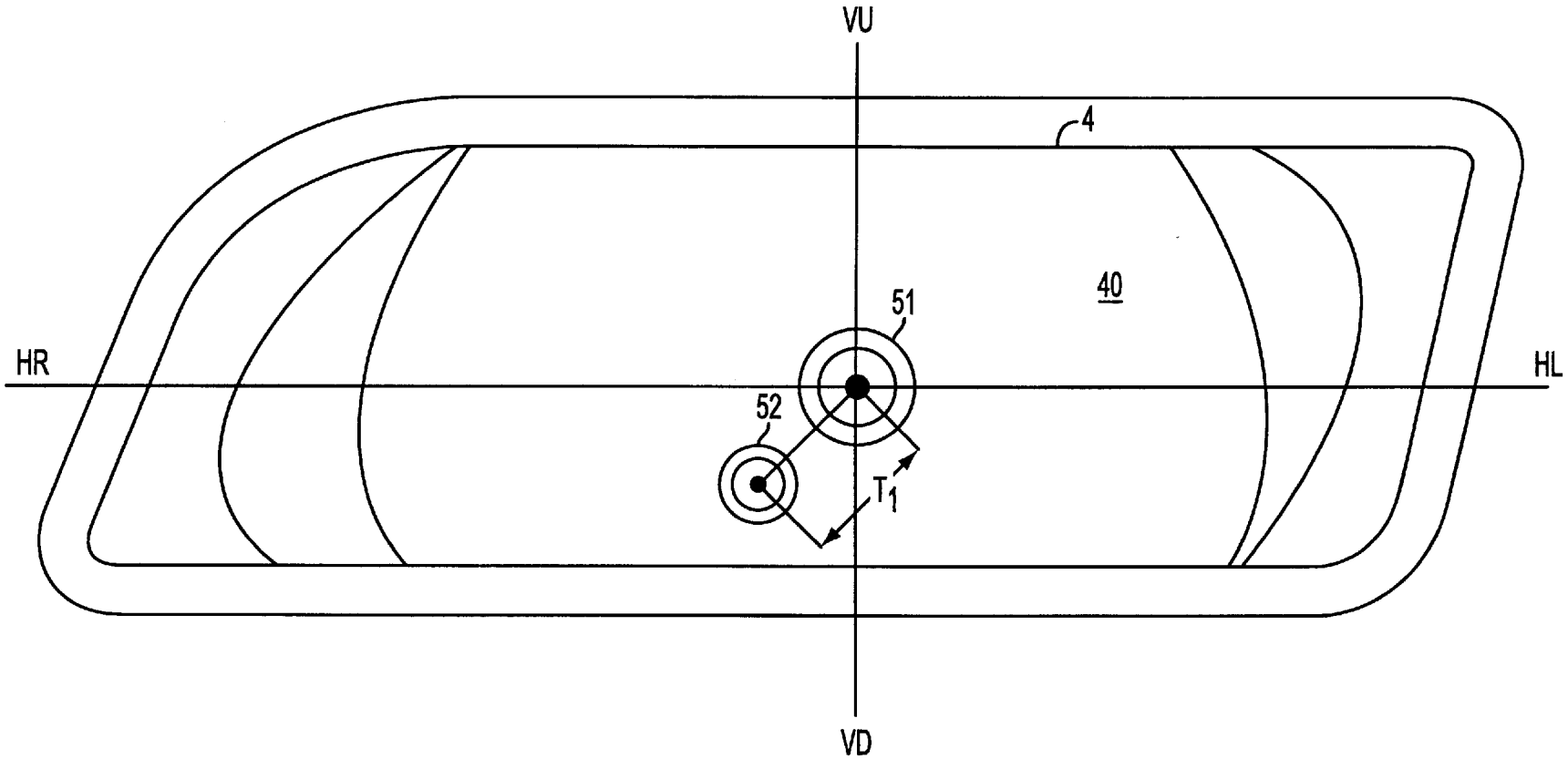
FIG. 25 is a front view of a headlamp in accordance with the invention.

Now the possibility to obtain good low beam light distribution pattern LP and high beam light distribution pattern HP without glaring light under conditions of the reflector 4 and the light source 5 as described blow, when the value is θ is set in a range from 10° to 30° and the values of T1 and T2 are set in ranges from 2.0 to 3.5 mm and from 1.5 to 4.0 mm, respectively, will be described below with reference to the isocandela diagrams shown in FIG. 9 through FIG. 14 based on experimental data See e.g., FIG. 25.

Dimensions of the reflector 4 are 90 mm×180 mm×85 mm. The glass bulb 50 of the light source bulb 5 is 16 mm in diameter, the low beam filament 51 is 5.5 mm in length, 1.5 mm in diameter and has luminous flux of 860 lm, and the high beam filament 52 is 5.0 mm in length, 1.3 mm in diameter and has luminous flux of 1300 lm.

Figure 9A:
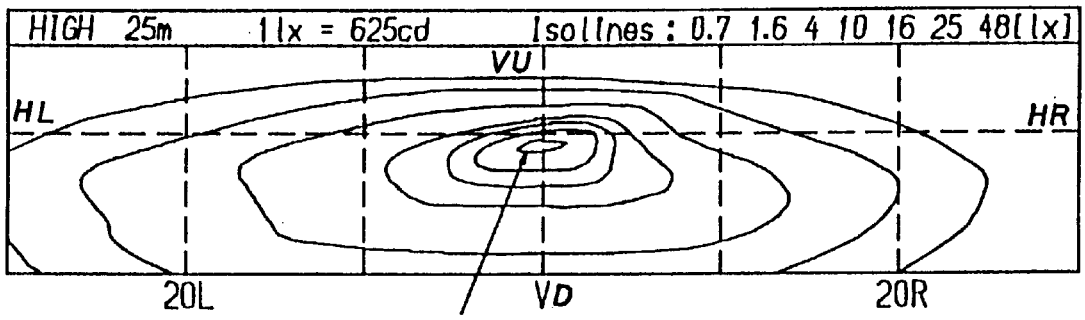
FIG. 9A shows the isocandela diagrams when the value of θ is 5°.
Figure 9B:
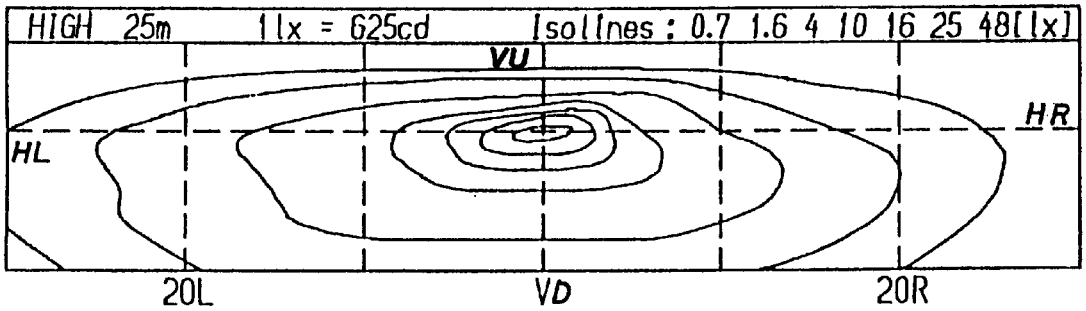
FIG. 9B shows the isocandela diagrams when the value of θ is 20° and FIG. 9C shows the isocandela diagrams when the value of θ is 35°, each showing the changes in the light distribution pattern of the low beam.
Figure 9C:
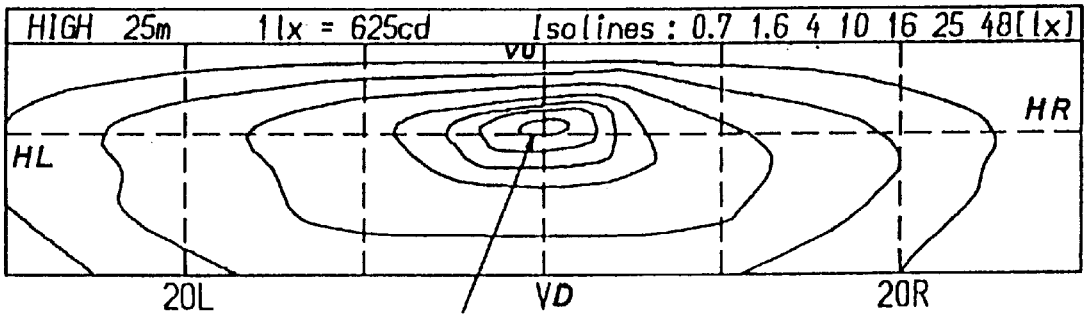
Figure 10A:
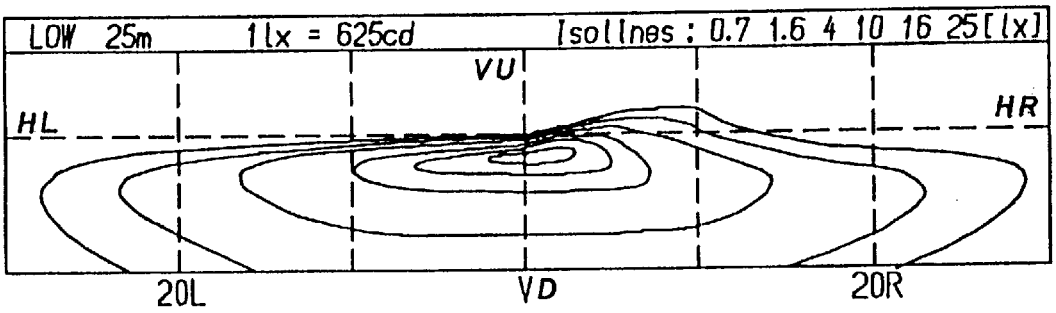
FIG. 10A shows the isocandela diagrams when the value of θ is 5°.
Figure 10B:
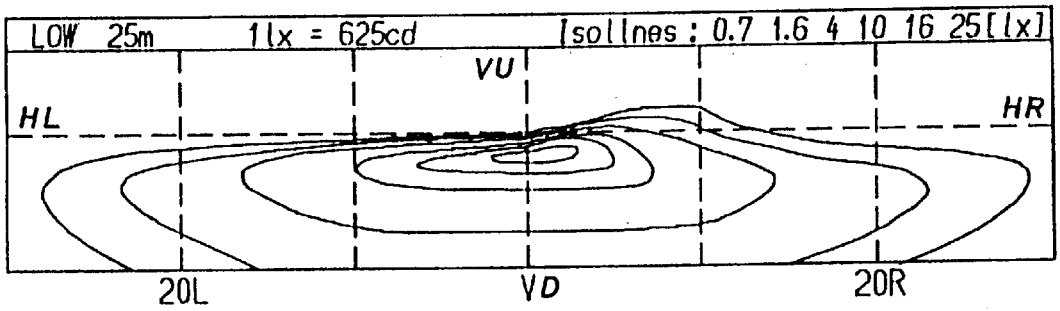
FIG. 10B shows the isocandela diagrams when the value of θ is 20° and FIG. 10C shows the isocandela diagrams when the value of θ is 35°, each showing the changes in the light distribution patterns of the high beam.
Figure 10C:
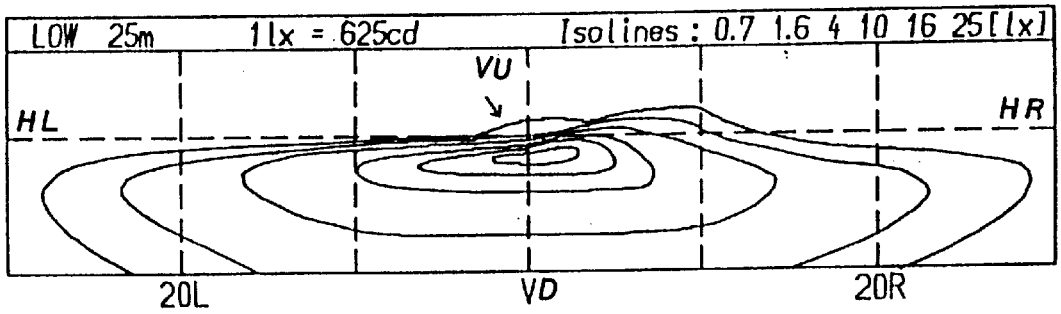
Figure 11A:
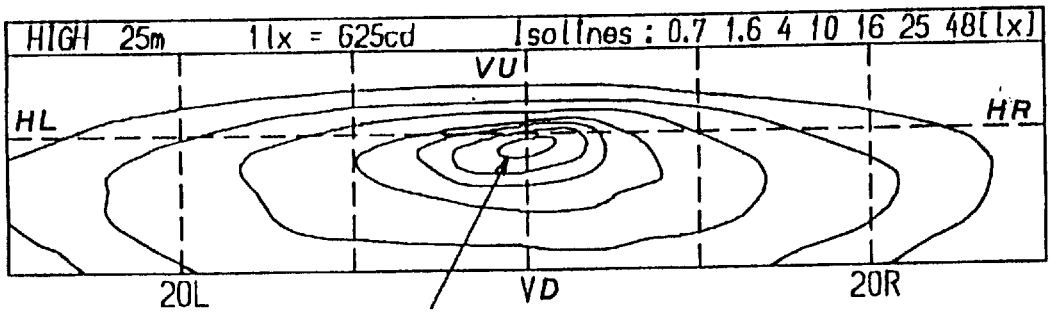
FIG. 11A shows the isocandela diagrams when the value of T1 is 1.5 mm.
Figure 11B:
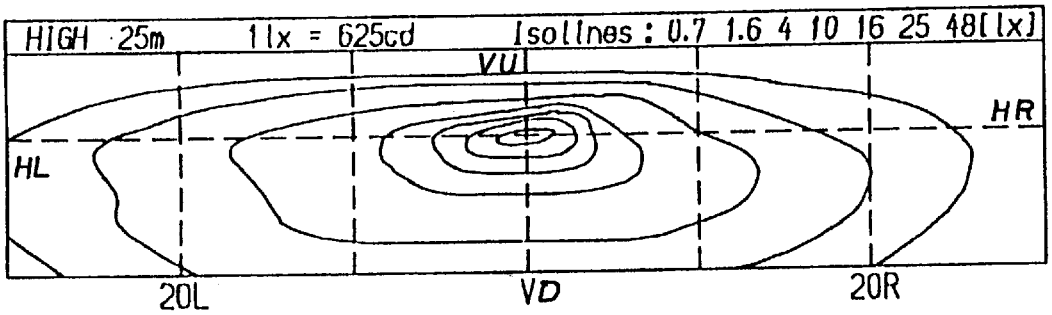
FIG. 11B shows the isocandela diagrams when the value of T1 is 2.8 mm
Figure 11C:
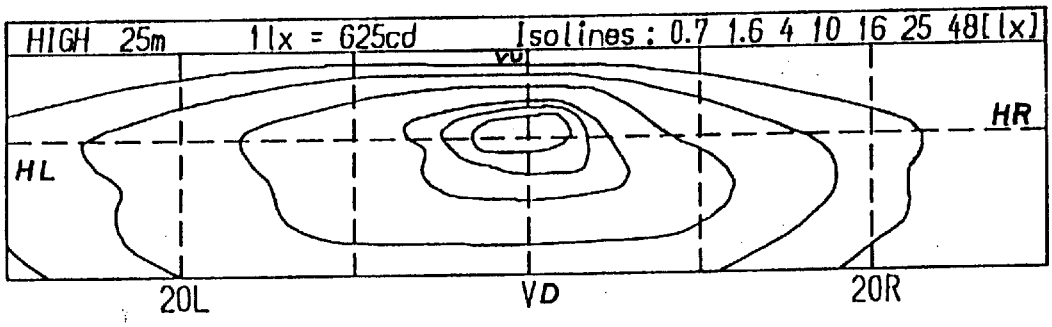
FIG. 11C shows the isocandela diagrams when the value of T1 is 4.0 mm, each showing the changes in the light distribution pattern of the low beam.
Figure 12A:
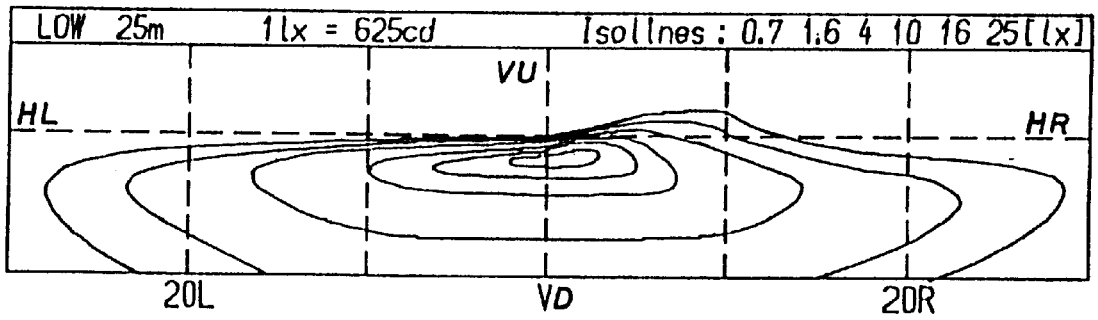
FIG. 12A shows the isocandela diagrams when the value of T1 is 1.5 mm.
Figure 12B:
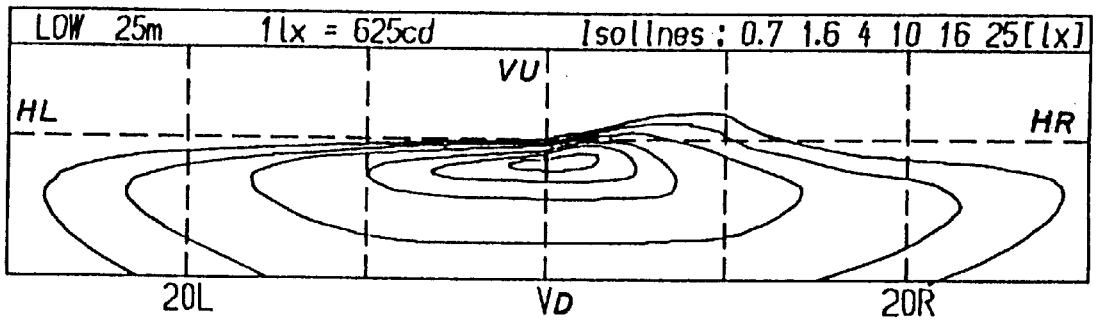
FIG. 12B shows the isocandela diagrams when the value of T1 is 2.8 mm
Figure 12C:
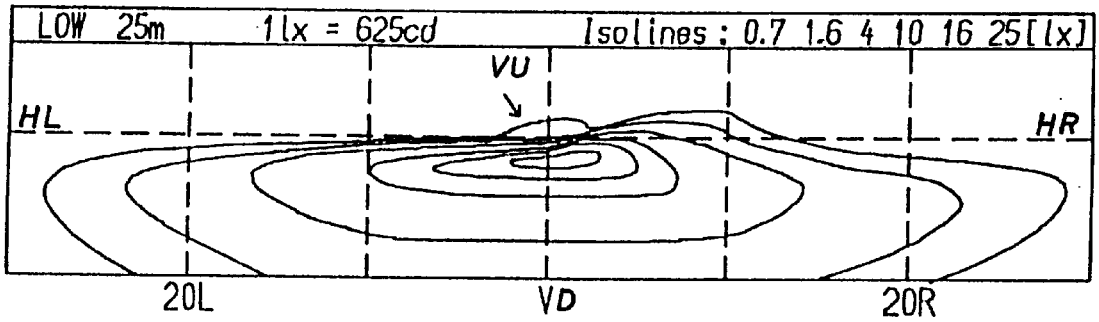
FIG. 12C shows the isocandela diagrams when the value of T1 is 4.0 mm, each showing the changes in the light distribution pattern of the high beam.
Figure 13A:
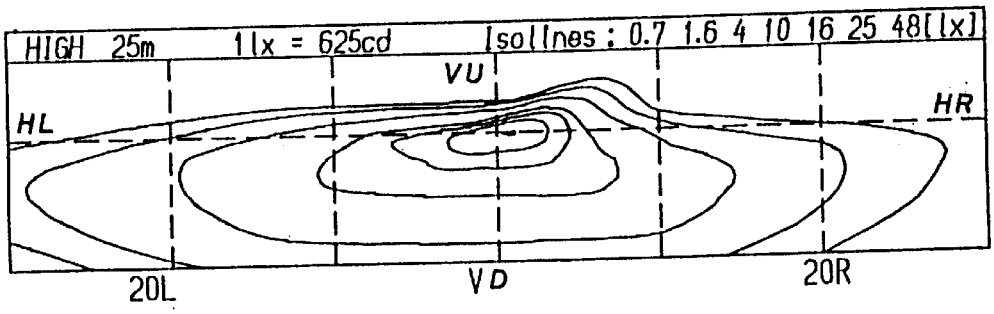
FIG. 13A shows the isocandela diagrams when the value of T2 is 1.0 mm.

FIGS. 9A, B, C, FIGS. 11A, B, C and FIGS. 13A, B, C show isocandela diagrams, measured on a screen at a distance of 25 m, that represent the high beam light distribution patterns. The isocandela diagrams in the drawings are lines of 0.7, 1.6, 4, 10, 16, 25 and 48 [lx] (1 lx=625 cd), from the outermost one inward. FIGS. 10A, B, C, FIGS. 12A, B, C and FIGS. 14A, B, C show isocandela diagrams, measured on a screen at a distance of 25 m, that represent the low beam light distribution patterns. The isocandela diagrams are lines of 0.7, 1.6, 4, 10, 16 and 25 [lx] (1 lx=625 cd), from the outermost one inward. In FIG. 9 through FIG. 14, 20L represents 20° on the left and 20R represents 20° on the right.

FIGS. 9A, B, C and FIGS. 10A, B, C show isocandela diagrams that represent changes in the light distribution patterns of high beam and low beam with the value of θ, when the value of T1 is 2.8 mm and the value of T2 is 2.5 mm. FIG. 9A and FIG. 10A show the case of θ=5°, FIG. 9B and FIG. 10B show the case of θ=20° and FIG. 9C and FIG. 10C show the case of θ=35°. In the case of FIG. 9A, the maximum luminous intensity zone shifts downward below the horizontal line HL-HR, as indicated by an arrow. In the case of FIG. 9C, the maximum luminous intensity zone shifts upward above the horizontal line HL-HR, as indicated by an arrow. In the case of FIG. 10C, virtual image glare light is generated above the beam boundary line (verified with 0.7 [lx] line), as indicated by an arrow. Therefore, it is proper to set the value of θ in a range from 10° to 30° as described above.

FIGS. 11A, B, C and FIGS. 12A, B, C show isocandela diagrams that represent changes in the light distribution patterns of the high beam and the low beam with the value of T1, when the value of θ is set to 20° and the value of T2 is 2.5 mm. FIG. 11A and FIG. 12A show the case of T1=1.5 mm, FIG. 11B and FIG. 12B show the case of T1=2.8 mm and FIG. 11C and FIG. 12C show the case of T1=4.0 mm. In the case of FIG. 11A, the maximum luminous intensity zone shifts downward below the horizontal line HL-HR, as indicated by an arrow. In the case of FIG. 11C, light does not converge and the maximum luminous intensity decreases significantly (unable to verify with 48 [lx] line). In the case of FIG. 12C, virtual image glare light is generated above the beam boundary line (verified with 0.7 [lx] line), as indicated by an arrow. Therefore, it is proper to set the value of T1 in a range from 2.0 to 3.5 mm as described above.

Figure 13B:
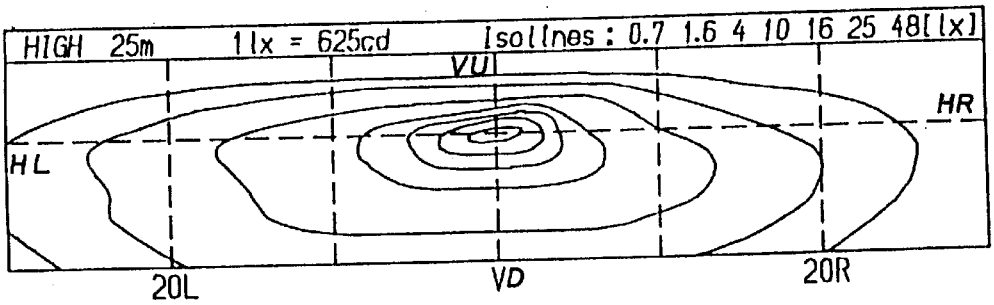
FIG. 13B shows the isocandela diagrams when the value of T2 is 2.5 mm
Figure 13C:
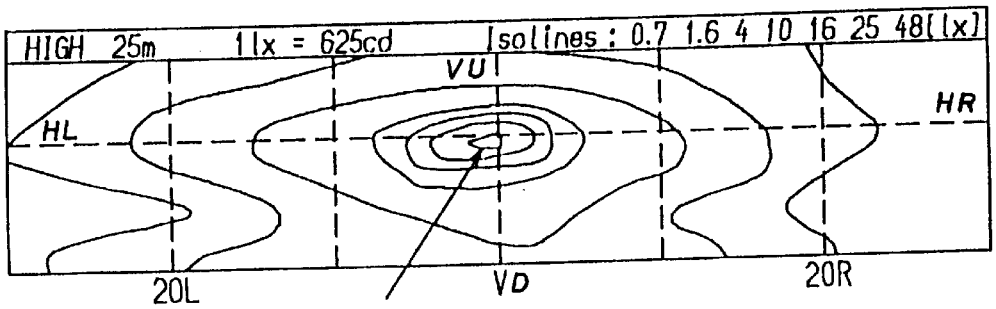
FIG. 13C shows the isocandela diagrams when the value of T2 is 4.5 mm, each showing the changes in the light distribution pattern of the low beam.
Figure 14A:
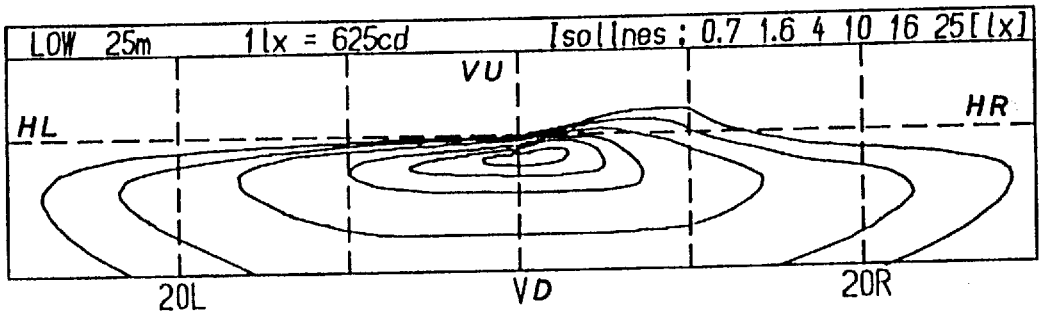
FIG. 14A shows the isocandela diagrams when the value of T2 is 1.0 mm.
Figure 14B:
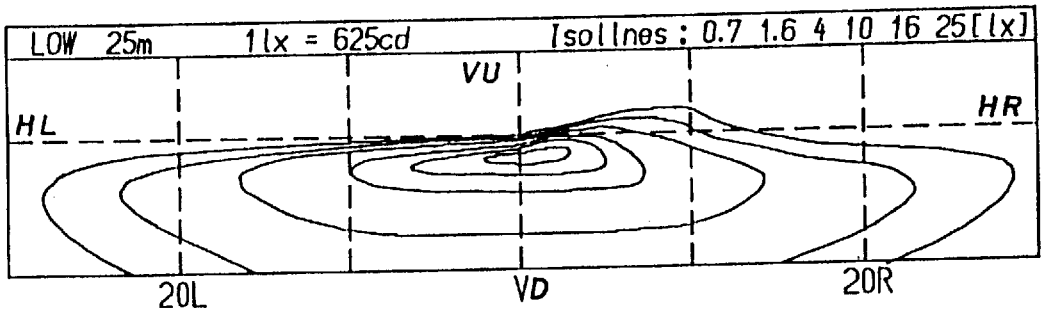
FIG. 14B shows the isocandela diagrams when the value of T2 is 2.5 mm
Figure 14C:
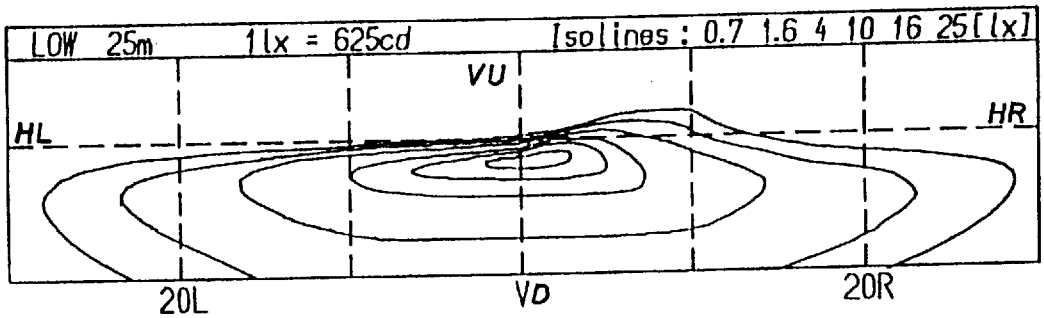
FIG. 14C shows the isocandela diagrams when the value of T2 is 4.5 mm, each showing the changes in the light distribution pattern of the high beam.
Figure 15:
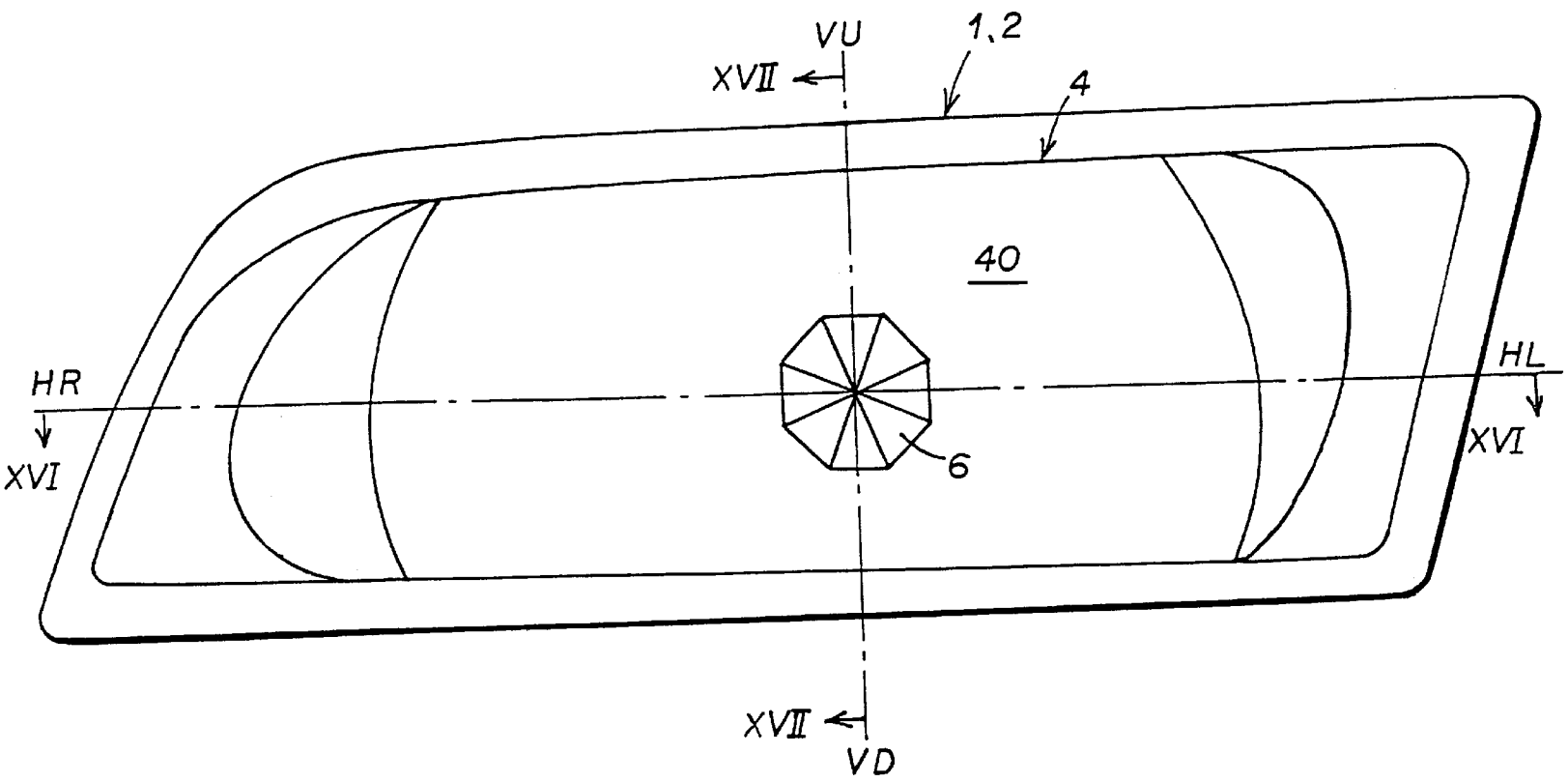
FIG.15 PRIOR ART
FIG. 15 is a front view of an automobile headlamp of a prior art showing a state where the reflecting surface of the reflector and the shade are seen through the lens.
Figure 16:
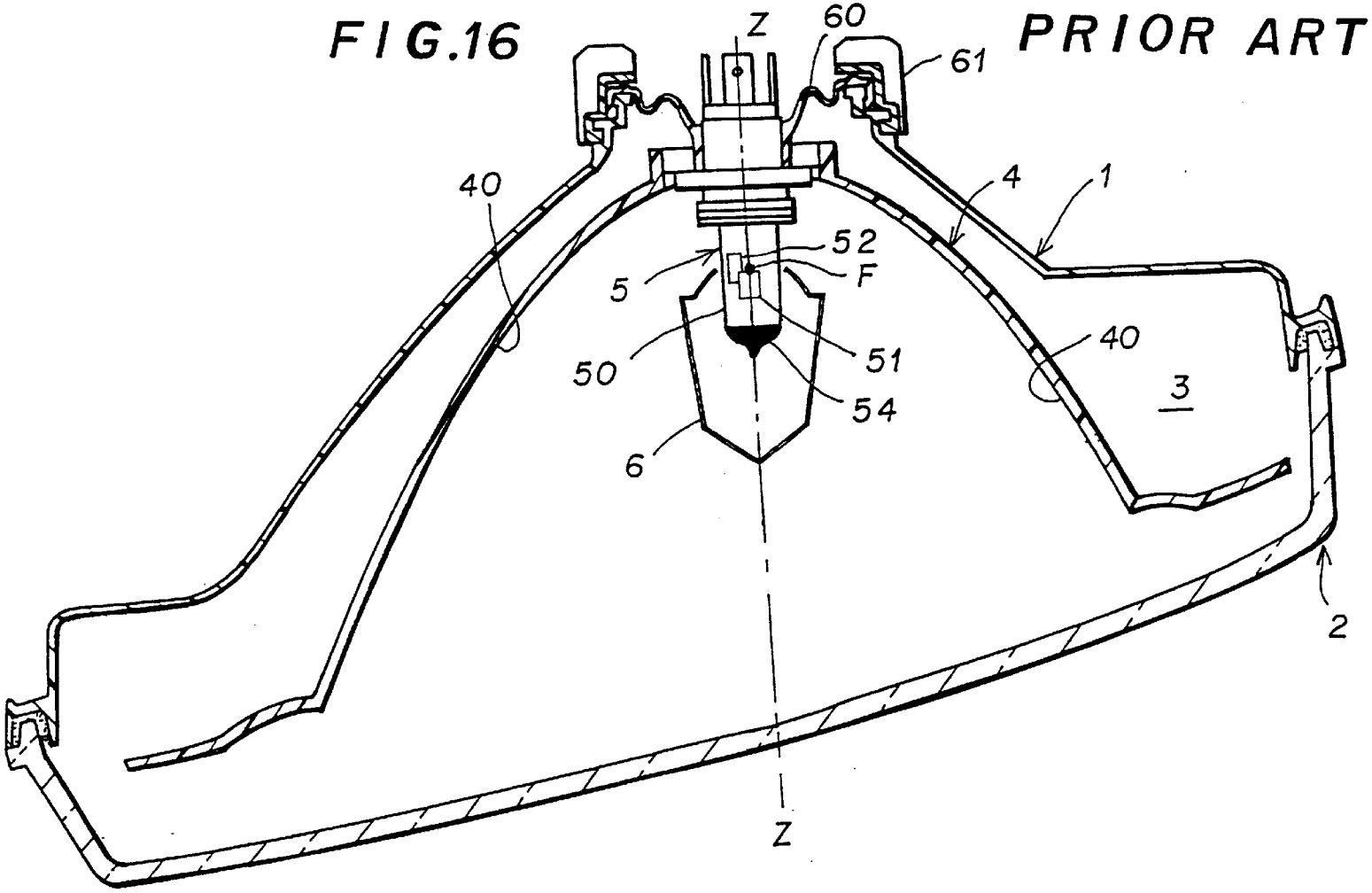
FIG.16 PRIOR ART
FIG. 16 is a cross sectional view along line XVI—XVI in FIG. 15.
Figure 17:
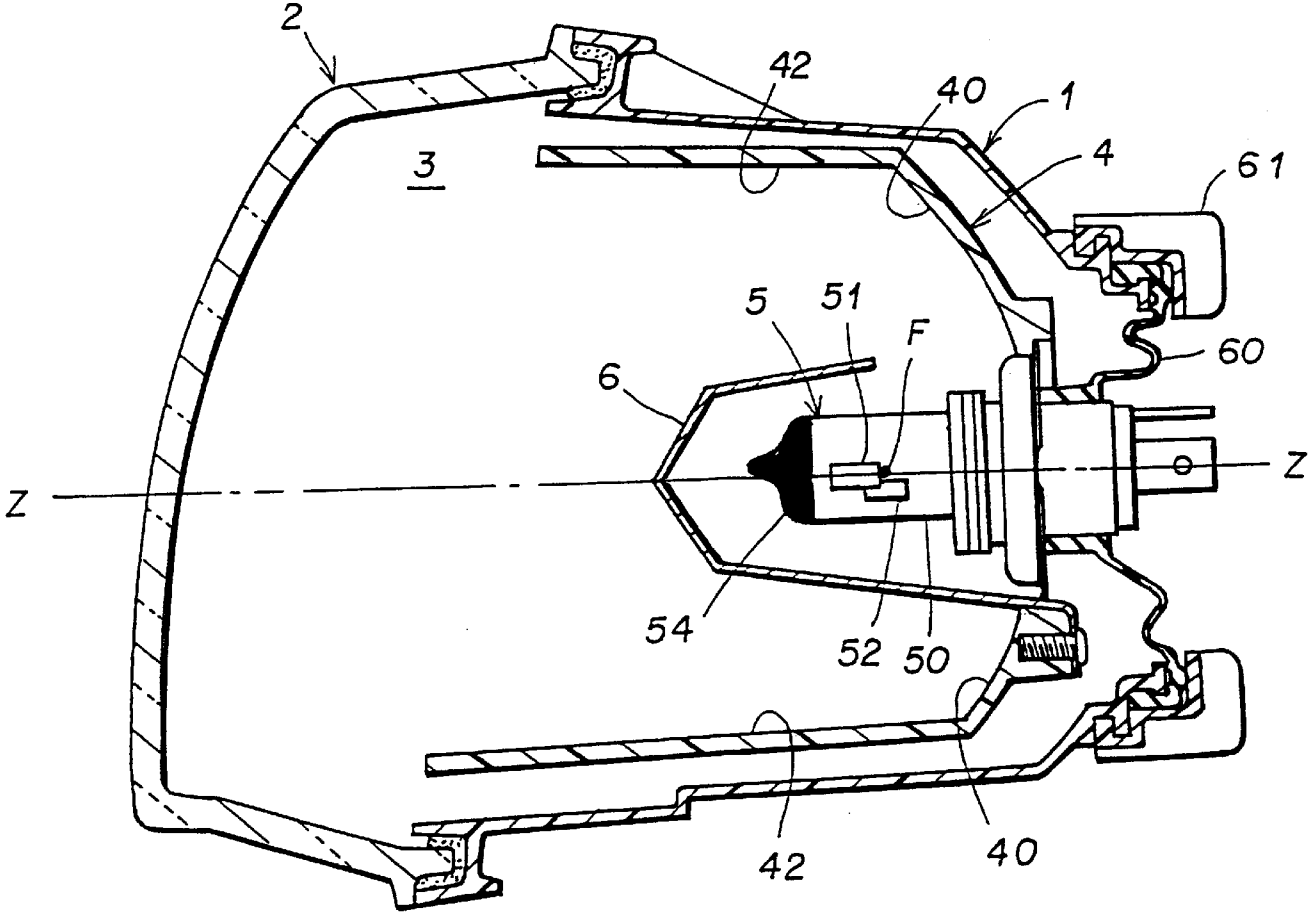
FIG.17 PRIOR ART
FIG. 17 is a cross sectional view along line XVII—XVII in FIG. 15.
Figure 18:
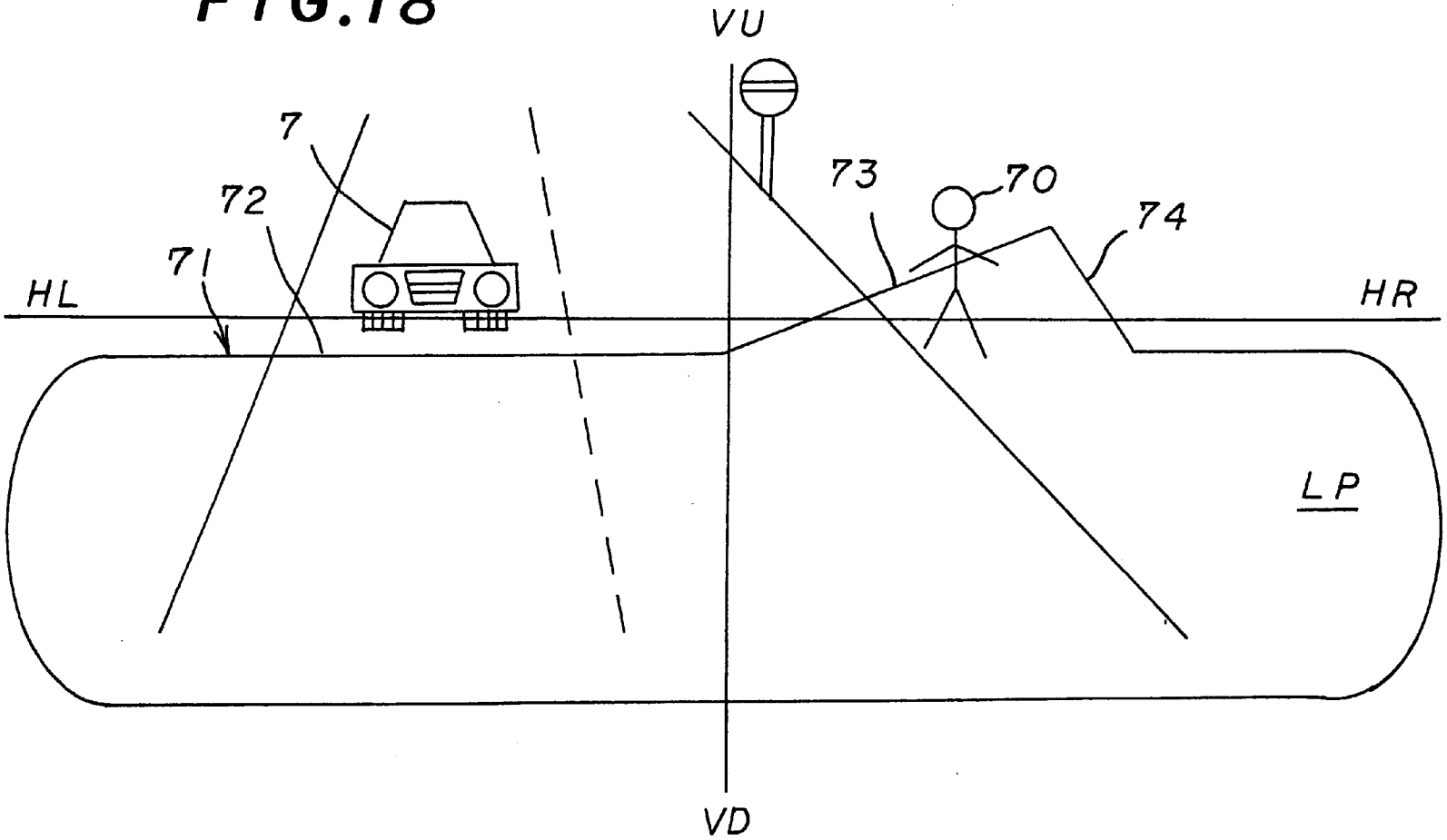
FIG. 18 shows an image of the low beam light distribution pattern.
Figure 19:
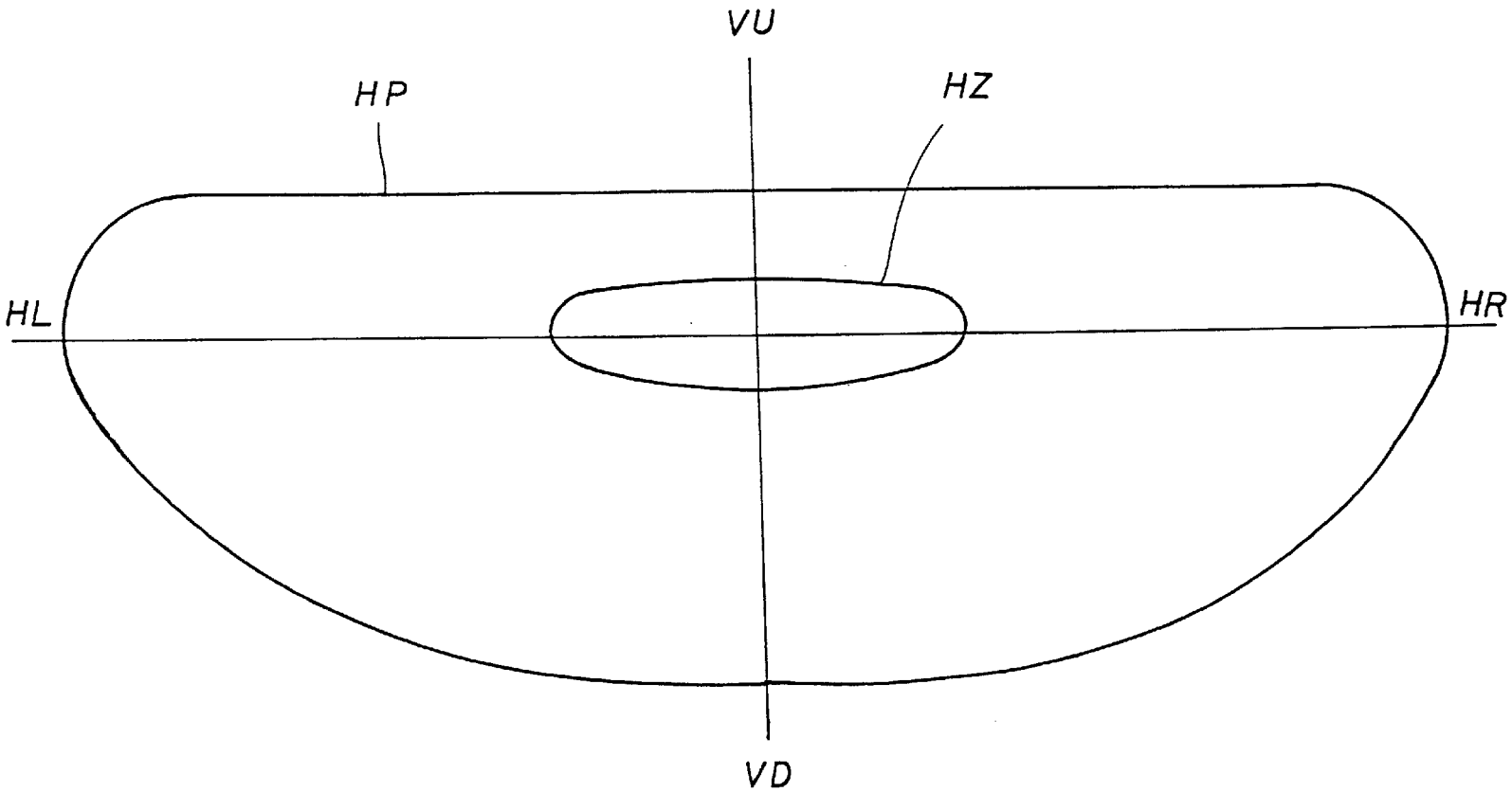
FIG. 19 shows an image of the high beam light distribution pattern.
Figure 20:
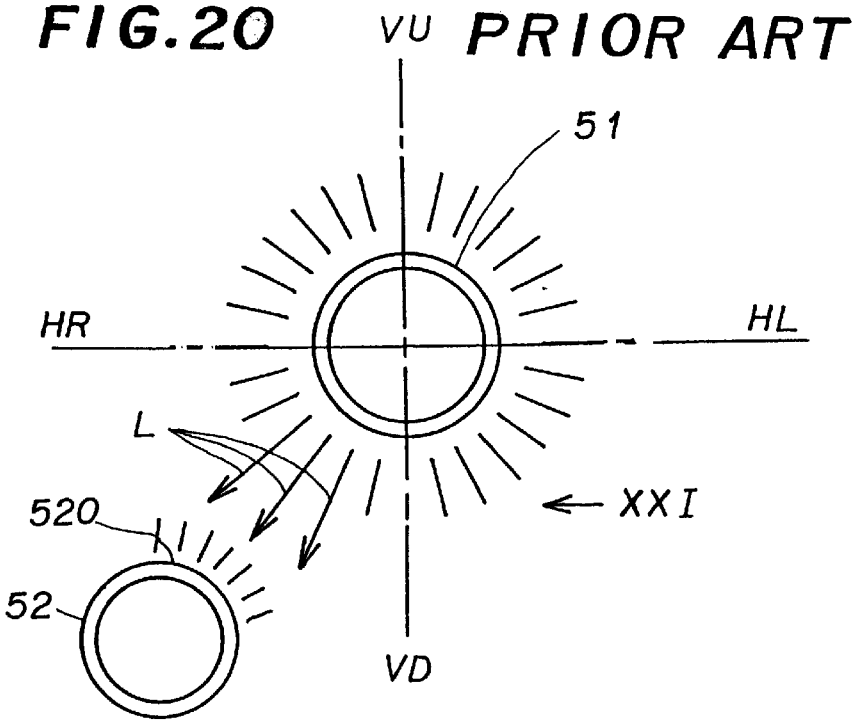
FIG.20 PRIOR ART
FIG. 20 is a front view of the automobile headlamp of the prior art explanatory of the positional relationship between the low beam filament and the high beam filament.
Figure 21:
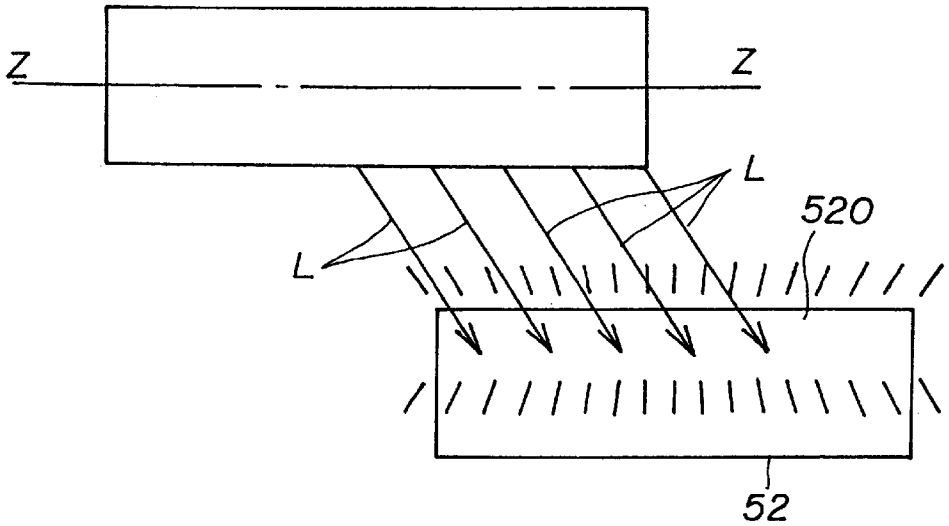
FIG.21 PRIOR ART
FIG. 21 is a view along line XXI in FIG. 20.
Figure 22:
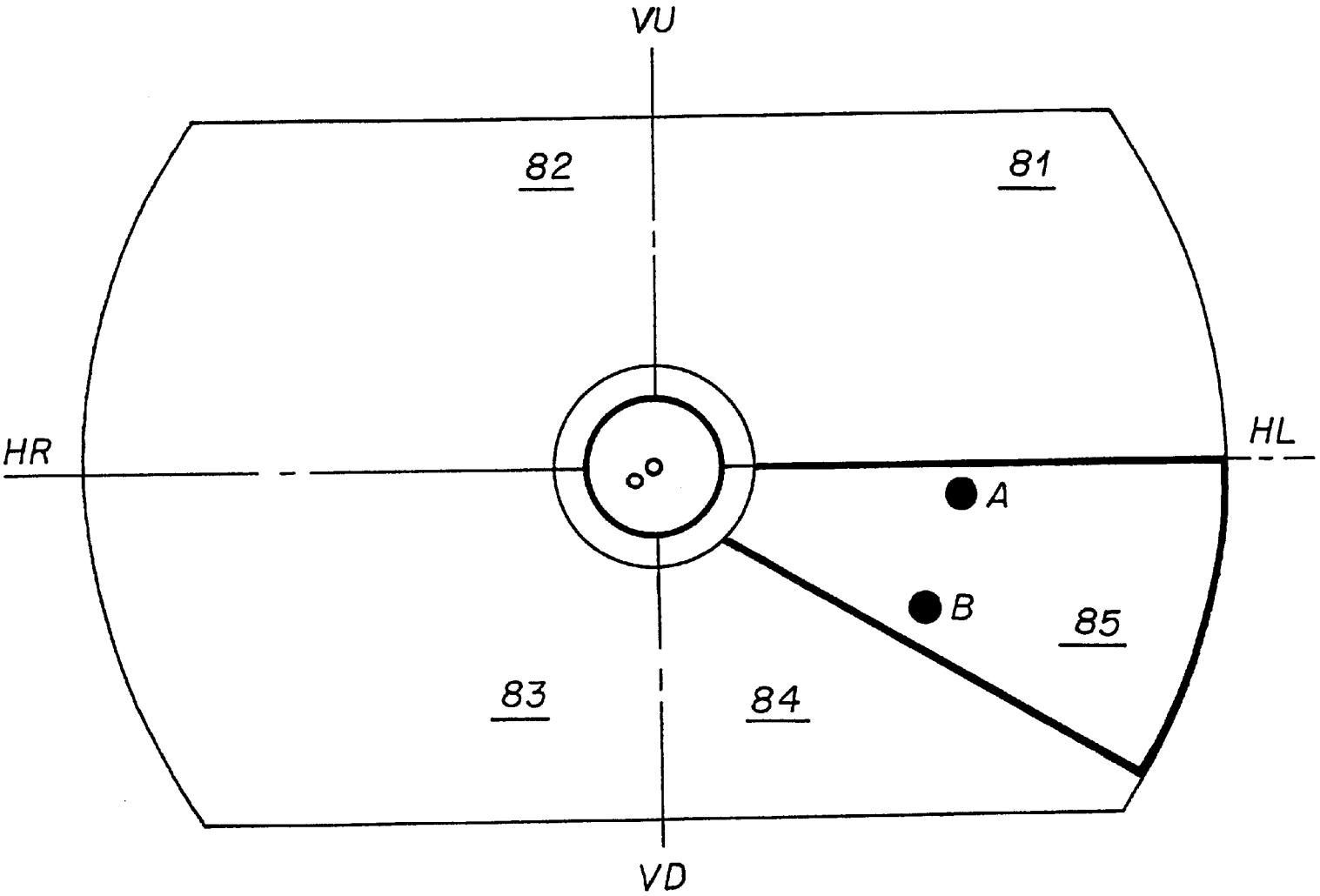
FIG.22 PRIOR ART
FIG. 22 is a front view of the reflecting surface of the automobile headlamp of the prior art.
Figure 23:
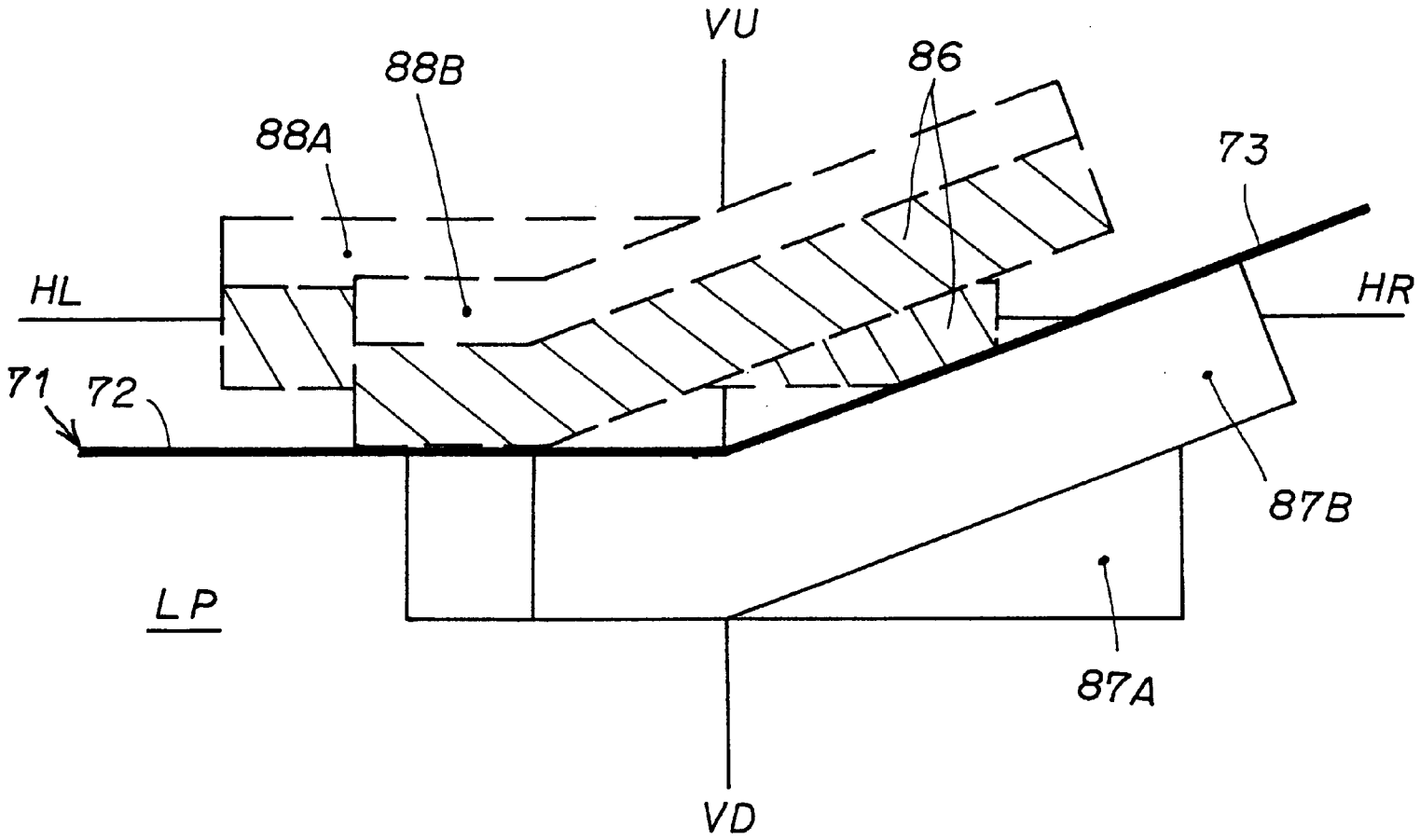
FIG.23 PRIOR ART
FIG. 23 is a screen image diagram for the explanation of a state where the virtual image glare light appears in the automobile headlamp of the prior art.
Figure 24:
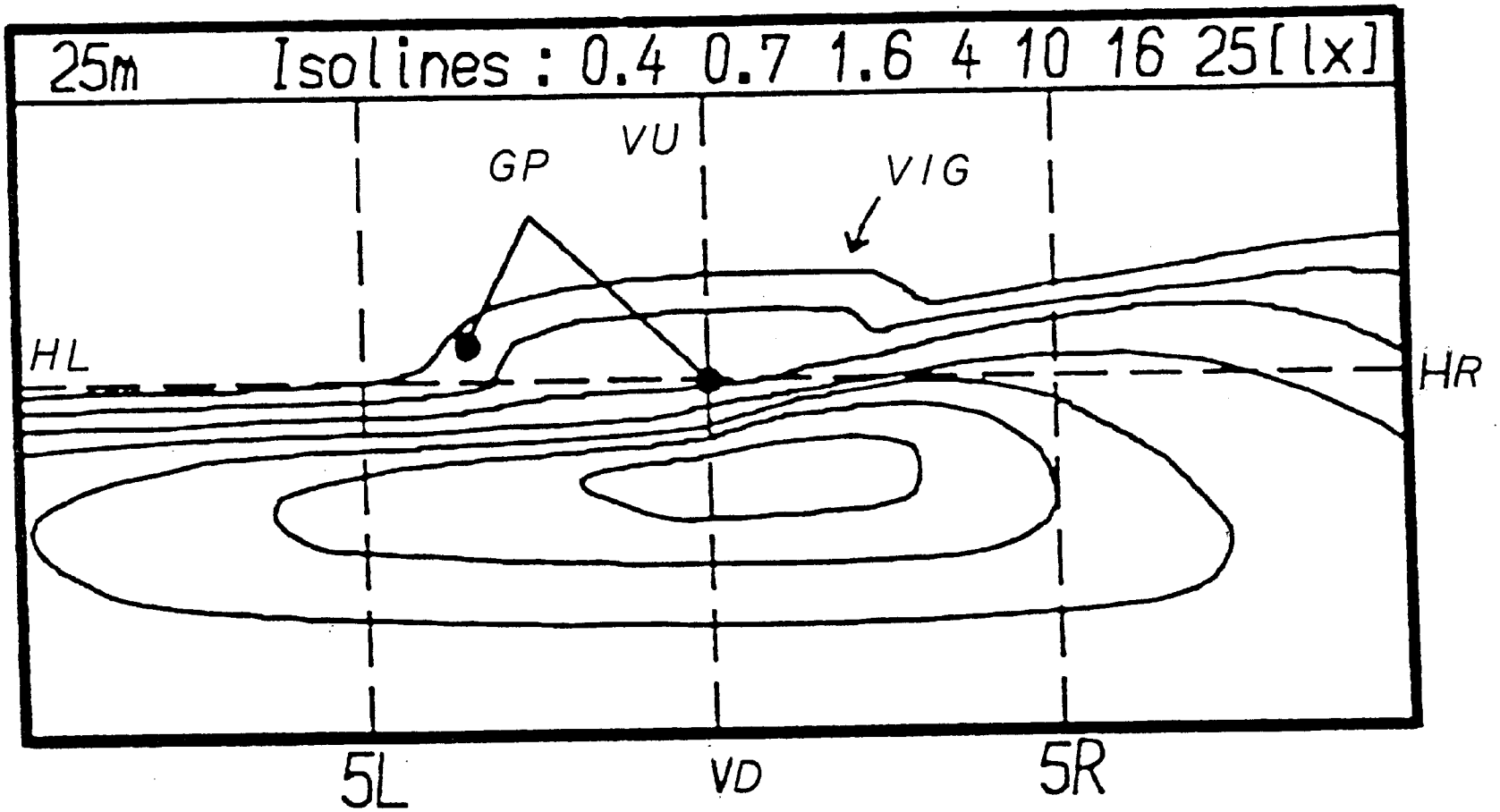
FIG. 24 PRIOR ART
FIG. 24 is an isocandela diagram showing a virtual image glare (glaring light) produced at a point (or zone) of the European Light Distribution Standard ECEReg. where glaring light is strictly limited, by the automobile headlamp of the prior art.

FIGS. 13A, B, C and FIGS. 14A, B, C show isocandela diagrams that represent changes in the light distribution patterns of the high beam and the low beam with the value of T2, when the value of θ is set to 20° and the value of T1 is 2.8 mm. FIG. 13A and FIG. 14A show the case of T2=1.0 mm, FIG. 13B and FIG. 14B show the case of T2=2.5 mm and FIG. 13C and FIG. 14C show the case of T2=4.5 mm. In the case of FIG. 13A, such a pattern as the low beam is shifted upward is obtained, that is not satisfactory for practical use as the high beam. In the case of FIG. 13C, the maximum luminous intensity zone shifts left-downward below the horizontal line HL-HR, as indicated by an arrow, and the pattern splits into upper and lower parts. Therefore, it is proper to set the value of T2 in a range from 1.5 to 4.0 mm as described above.

In the embodiment described above, the low beam filament 51 is disposed under the following conditions. That is, the center of front view projection of the low beam filament 51 is the intersect of the vertical line VU-VD and the horizontal line HL-HR and is located on the optical axis Z—Z, while the central axis of the side view projection of the low beam filament 51 corresponds with the optical axis Z—Z. However, the present invention can be applied also to an automobile headlamp wherein the low beam filament 51 is disposed under condition other than those described above. That is, according to the present invention, it suffices for the automobile headlamp to satisfy the conditions of the positional relationship between the low beam filament 51 and the high beam filament 52 described above.

While the above description of the embodiment deals with the virtual image glare 86 of the irradiated portion 520 of the high beam filament 52 when the low beam filament 51 is turned on, the virtual image of the irradiated portion of the low beam filament 51 when the high beam filament 52 is turned on is located substantially in the hot zone HZ of the high beam light distribution pattern HP, and therefore does not pose a problem.

In the embodiment described above, since the predetermined low beam light distribution pattern LP and high beam light distribution pattern HP are formed by control of all-surface reflection light distribution of the reflecting surface 40, the lens 2 may be either a plain lens that transmits light or one that has a group of diffusive optical elements (the so-called diffusive prism elements) or the like.

While the lamp housing 1 and the reflector 4 that has the reflecting surface 40 are separate from each other in the embodiment described above, the automobile headlamp according to the present invention may also be applied to such a construction as the lamp housing and the reflector are made in an integral body.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. An automobile headlamp comprising a light source bulb and a reflector, wherein:

said light source bulb has a low beam filament disposed on an optical axis of said reflector above and near a high beam filament;

said reflector has a reflecting surface formed from a complex reflecting surface so that, when said low beam filament is turned on, a predetermined low beam light distribution pattern is formed by control of all-surface reflection light distribution of said reflecting surface and, when said high beam filament is turned on, a predetermined high beam light distribution pattern is formed by the control of all-surface reflection light distribution of the reflecting surface, while said reflecting surface has a portion for forming a maximum luminous intensity zone in said predetermined low beam light distribution pattern and high beam light distribution pattern;

when said low beam filament is turned on, a part of light from said low beam filament illuminates a part of said high beam filament and is reflected on the surface thereof, so that the irradiated part of said high beam filament appears as a virtual image in said low beam light distribution pattern due to the maximum luminous intensity zone forming portion of said reflecting surface;

said automobile headlamp characterized in that said low beam filament and said high beam filament have such a positional relationship as the virtual image of the irradiated part of said high beam filament does not make glaring light in said low beam light distribution pattern.

2. An automobile headlamp according to claim 1, wherein the positional relationships between said low beam filament and said high beam filament are an angle between a line connecting a center of the low beam filament and a center of the high beam filament in the front view projection and a horizontal line; a distance between the center of the low beam filament and the center of the high beam filament in the front view projection; and a distance between the center of the low beam filament and the center of the high beam filament in a longitudinal direction in the side view projection.

3. An automobile headlamp according to claim 1, wherein under such conditions that said light source bulb has a glass bulb having a diameter in a range from 14 to 18 mm, said low beam filament and said high beam filament are from 4.0 to 6.0 mm in length and said low beam filament and said high beam filament are from 1.2 to 1.6 mm in diameter, the angle between the line connecting the center of the low beam filament and the center of the high beam filament in the front view projection and the horizontal line is in a range from 10° to 30°; the distance between the center of the low beam filament and the center of the high beam filament in the front view projection is in a range from 2.0 to 3.5 mm; and the distance between the center of the low beam filament and the center of the high beam filament in the longitudinal direction in the side view projection is in a range from 1.5 to 4.0 mm.

4. An automobile headlamp comprising:

a light source bulb; and a reflector, wherein said light source bulb has a low beam filament disposed above and near a high beam filament;

said reflector has a reflecting surface formed from a complex reflecting surface so that, when said low beam filament is turned on, a predetermined low beam light distribution pattern is formed by control of all-surface reflection light distribution of said reflecting surface and, when said high beam filament is turned on, a predetermined high beam light distribution pattern is formed by the control of all-surface reflection light distribution of the reflecting surface, while said reflecting surface has a portion for forming a maximum luminous intensity zone in said predetermined low beam light distribution pattern and high beam light distribution pattern, when said low beam filament is turned on, a part of light from said low beam filament illuminates a part of said high beam filament and is reflected on the surface thereof, so that the irradiated part of said high beam filament appears as a virtual image in said low beam light distribution pattern due to the maximum luminous intensity zone forming portion of said reflecting surface, wherein said low beam filament and said high beam filament have a positional relationship such that the virtual image of the irradiated part of said high beam filament does not make glaring light in said low beam light distribution pattern, wherein said light source bulb has a glass bulb having a diameter in a range from 14 to 18 mm, said low beam filament and said high beam filament are from 4.0 to 6.0 mm in length and said low beam filament and said high beam filament are from 1.2 to 1.6 mm in diameter, and wherein the angle between the line connecting the center of the low beam filament and the center of the high beam filament in the front view projection and the horizontal line is in a range from 10° to 30°, the distance between the center of the low beam filament and the center of the high beam filament in the front view projection is in a range from 2.0 to 3.5 mm; and the distance between the center of the low beam filament and the center of the high beam filament in the longitudinal direction in the side view projection is in a range from 1.5 to 4.0 mm.

5. A vehicle, comprising:

a body; and an automobile headlamp, comprising a light source bulb and a reflector, coupled to the body, wherein:

said light source bulb has a low beam filament disposed on an optical axis of said reflector above and near a high beam filament;

said reflector has a reflecting surface formed from a complex reflecting surface so that, when said low beam filament is turned on, a predetermined low beam light distribution pattern is formed by control of all-surface reflection light distribution of said reflecting surface and, when said high beam filament is turned on, a predetermined high beam light distribution pattern is formed by the control of all-surface reflection light distribution of the reflecting surface, while said reflecting surface has a portion for forming a maximum luminous intensity zone in said predetermined low beam light distribution pattern and high beam light distribution pattern;

when said low beam filament is turned on, a part of light from said low beam filament illuminates a part of said high beam filament and is reflected on the surface thereof, so that the irradiated part of said high beam filament appears as a virtual image in said low beam light distribution pattern due to the maximum luminous intensity zone forming portion of said reflecting surface;

said automobile headlamp characterized in that said low beam filament and said high beam filament have such a positional relationship as the virtual image of the irradiated part of said high beam filament does not make glaring light in said low beam light distribution pattern.

* * * * *